United States Patent [19]

Steifensand

[11] Patent Number: 4,564,237

[45] Date of Patent: Jan. 14, 1986

[54] SEAT ARRANGEMENT

[76] Inventor: Friedrich M. Steifensand, Sperberslohler Strasse 124, D-8501 Wendelstein, Fed. Rep. of Germany

[21] Appl. No.: 725,502

[22] Filed: Apr. 24, 1985

Related U.S. Application Data

[63] Continuation of Ser. No. 332,619, Dec. 21, 1981.

[30] Foreign Application Priority Data

Jul. 28, 1981 [DE] Fed. Rep. of Germany ..... 3129647

[51] Int. Cl.[4] ..... A47C 7/50

[52] U.S. Cl. ..... 297/423; 248/188.8; 297/195

[58] Field of Search ..... 297/195, 423; 248/188.8, 188.9, 344.1, 433, 438, 439, 172, 194

[56] References Cited

U.S. PATENT DOCUMENTS

| | | | |
|---|---|---|---|
| D. 159,975 | 9/1950 | Gilkison | 297/172 X |
| D. 169,012 | 3/1953 | Musacco | 297/172 X |
| 1,355,681 | 10/1920 | McNulty | 297/172 |
| 1,901,377 | 3/1933 | Roe | 248/345.1 |
| 1,970,874 | 8/1934 | Yawman | 297/172 |
| 2,716,255 | 8/1955 | Laure | 248/188.9 X |
| 2,894,561 | 7/1959 | Mackintosh | 297/172 |
| 3,037,570 | 6/1962 | Olson | 297/423 X |
| 3,523,710 | 8/1970 | Barecki et al. | 248/345.1 |
| 3,541,313 | 11/1970 | Buzzi | 297/195 |
| 3,622,199 | 11/1971 | Ho | 297/172 |
| 3,704,847 | 12/1972 | Schmidtt | 297/423 |
| 4,105,271 | 8/1978 | Sebel et al. | 248/163 R |
| 4,201,359 | 5/1980 | Baslow | 248/345.1 |
| 4,221,308 | 12/1983 | Nagy | 211/22 |
| 4,328,991 | 5/1982 | Mengshoel et al. | 297/423 |
| 4,377,309 | 3/1983 | Mengshoel | 297/195 |

FOREIGN PATENT DOCUMENTS

| | | | |
|---|---|---|---|
| 961755 | 1/1975 | Canada . | |
| 0006729 | 9/1980 | European Pat. Off. . | |
| 0017450 | 10/1980 | European Pat. Off. . | |
| 0018812 | 11/1980 | European Pat. Off. . | |
| 2020658 | 11/1971 | Fed. Rep. of Germany . | |
| 2334400 | 1/1975 | Fed. Rep. of Germany . | |
| 961286 | 6/1964 | United Kingdom . | |
| 1180530 | 2/1970 | United Kingdom . | |
| 1347216 | 2/1974 | United Kingdom | 297/423 |
| 1556991 | 6/1976 | United Kingdom | 211/182 |
| 867164 | 5/1981 | United Kingdom . | |

*Primary Examiner*—James T. McCall

*Attorney, Agent, or Firm*—Hill, Van Santen, Steadman & Simpson

[57] ABSTRACT

A seat arrangement has a support surface for the buttocks, and a support or bearing surface for the knees and the shins, the two surfaces being connected to one another via a common framework. The framework has a base portion, which extends beyond the downwardly extending projections of the support and bearing surfaces. The base portion is a substantially continuous frame. The seat arrangement also has a base support consisting of two halves, each possessing an interior recess or sleeve for surrounding the respective metal tube of the other half of the base portion for fitting the two halves together.

8 Claims, 11 Drawing Figures

SEAT ARRANGEMENT

This is a continuation of application Ser. No. 332,619, filed Dec. 21, 1981.

BACKGROUND OF THE INVENTION

The present invention relates to a seat arrangement which has separate support surfaces for the buttocks and for the knees or shins, of the type described in Canadian Pat. No. 961,755. A disadvantage of the seat arrangement disclosed in Canadian Pat. No. 961,755 is that the so-called standing area of the seat arrangement on the floor is relatively small. As a result, it is possible for the seat arrangement to tip over relatively easily, both when unloaded and when loaded by a seated person, particularly while the person is in the act of sitting down on the seat arrangement, or rising from it.

It is an object of the present invention to provide a seat arrangement of this type which exhibits increased stability with respect to tipping over.

In accordance with the principles of the present invention the above object is inventively achieved in a seat arrangement with a support surface for the buttocks and a support or bearing surface for the knees and the shins, the two surfaces being connected to one another by means of a common framework. The framework has a base portion which is designed approximately in the form of a substantially continuous frame and which extends beyond the downwardly extending projections from the support and bearing surfaces.

Stability against tipping over is considerably increased because the base portion extends beyond the projection of the support or bearing surfaces, and because the base portion is in the form of a frame, security against tipping is present in every possible tipping direction, that is, not only to the sides but also forwards and backwards, obliquely forwards, and obliquely to the rear. The mechanical stability of the seat arrangement is considerably reinforced by this structure.

DESCRIPTION OF THE PREFERRED EMBODIMENTS

Figure 1:
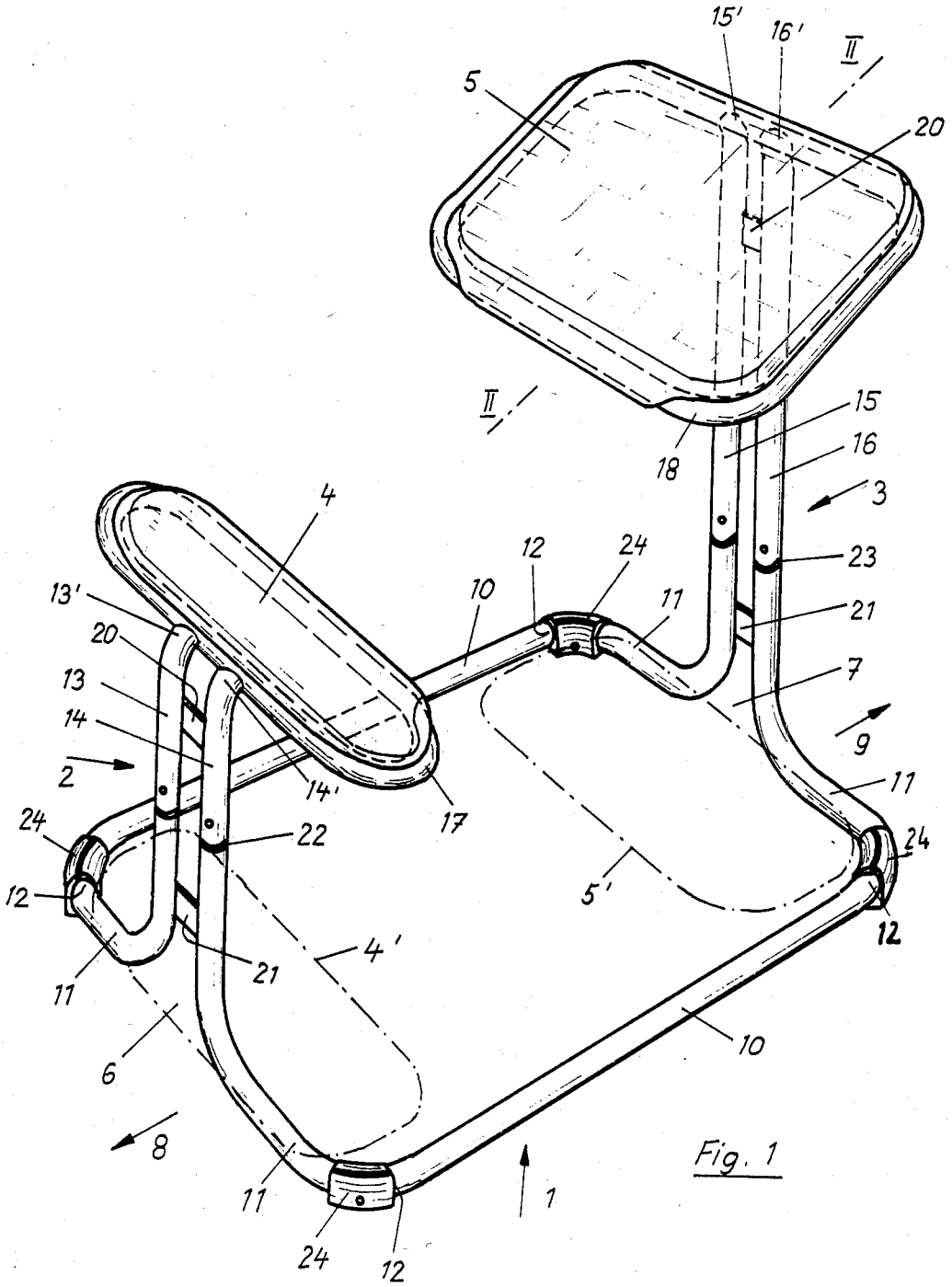
FIG. 1 is a perspective view of a seat arrangement constructed in accordance with the principles of the present invention.
Figure 2:
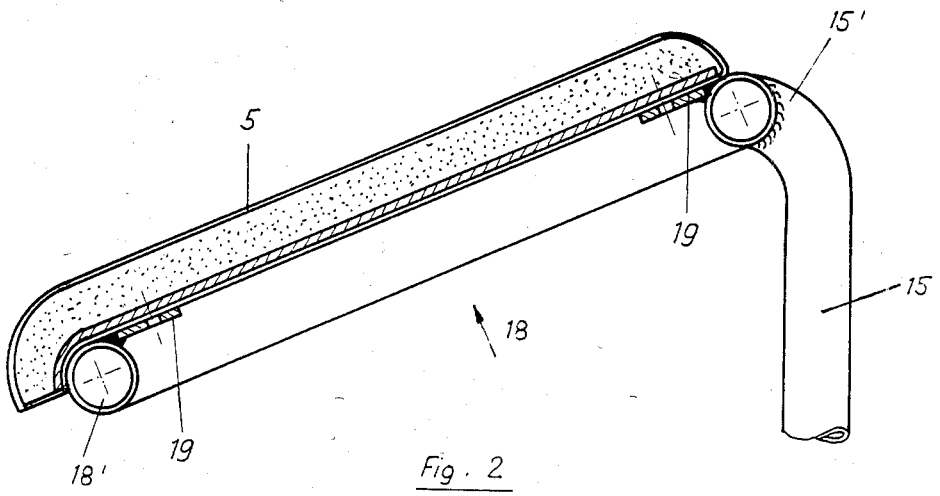
FIG. 2 is an enlarged sectional view taken along line II—II of FIG. 1.
Figure 3:
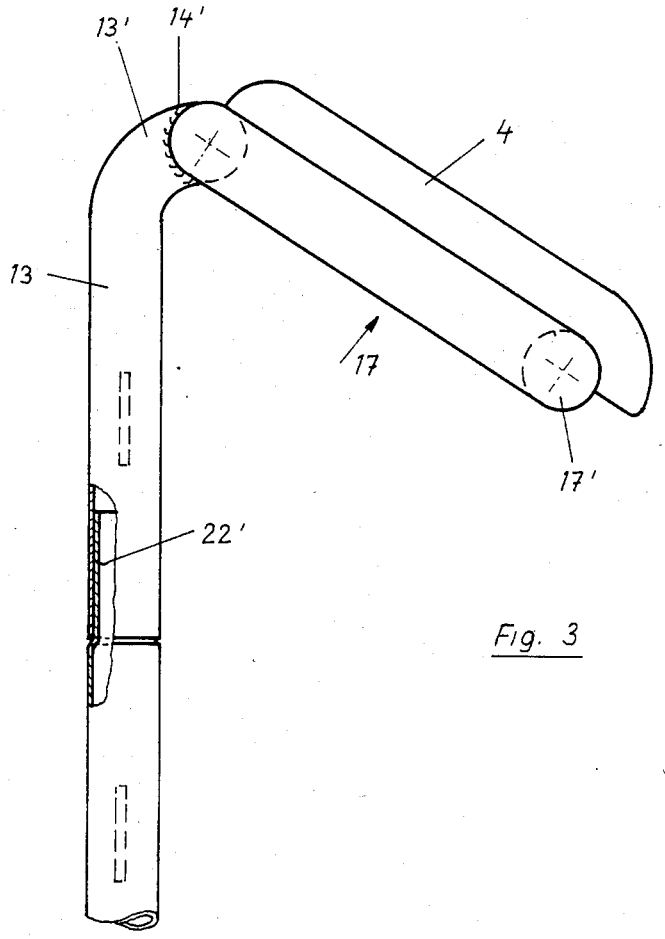
FIG. 3 is a partial side view of the support or bearing surface for the knees and shins with the associated load bearing member taken from FIG. 1.

A seat arrangement constructed in accordance with the principles of the present invention is shown in FIG. 1 which includes a frame-like base portion 1, a front load bearing assembly 2, a rear load bearing assembly 3, an unitary support or bearing surface 4 for the knees or for the shins of a seated person, and an unitary support surface 5 for the bottocks of the seated person. The two surfaces 4 and 5 are preferably upholstered and are disposed at an angle with respect to the horizontal as shown in FIGS. 2 and 3 so as to respectively extend from an outside uppermost position to a lowermost bottom position which is in the interior of the seating arrangement. A person sitting on the seat arrangement is thus supported by the knees, or the portions of the shins below the knees, on the support surface 4 and sits on the support surface 5.

The projections of the surfaces 4 and 5 on the horizontal plane, such as a floor, on which the seat arrangement may be disposed are shown at 4' and 5' in dash-dot lines. As can be seen in FIG. 1, the base portion 1 extends beyond these projections, and the frame-like design of the base portion 1 can be recognized. This portion is substantially continuous with the exception of the gaps 6 and 7 which are necessary in this embodiment to form the lower portion for the load bearing assemblies 2 and 3 described below in greater detail. The base portion 1 may be extended forward in the direction of arrow 8 and/or rearward in the direction of arrow 9 beyond the projections 4' and 5' without departing from the inventive concept disclosed herein.

FIG. 1 additionally illustrates the preferred embodiment of the invention, which is a rectangular or square configuration of the base portion 1 with two side struts or member 10 and curved front and rear struts or ends 11 which join at arced corners 12. The radii of curvature of the corners 12 are preferably equal to one another. The load bearing assemblies or vertical support struts 2 and 3 are centrally located on the ends of the base portion 1 formed by the struts 11 and respectively associated extensions of those struts extending upwardly. The load bearing assemblies 2 and 3 are preferably disposed within the projections 4' and 5'. This arrangement permits the load bearing assemblies 2 and 3 to extend vertically downward and significantly contributes to the overall stability of the seat arrangement. All portions of the framework are manufactured from metal tubes in this preferred embodiment of the invention.

The load bearing assemblies 2 and 3 further respectively comprise two metal tubes 13 and 14, and 15 and 16, which merge toward the bottom of the respective struts 11 of the base portion 1. At the top of the load bearing assemblies 2 and 3 the metal tubes 13 and 14 and the metal tubes 15 and 16 are bent inwardly, that is, toward the respective support surface connected thereto. The curved portions 13' and 14' are welded to a frame 17 which encircles the support surface 4 and the curved portions 15' and 16' are welded to a frame 18 which encircles the support surface 5. In this preferred embodiment of the invention, only tubes having curvatures with relatively large radii of curvature are needed for the frames 17 and 18 and for the attachment of these frames to the load bearing assemblies. This facilitates manufacture and assembly because members having large radii of curvature are much easier to produce than elements having small radii of curvature. The shape and inclination of the frames 17 and 18 corresponds to the shape and inclination of the respective support surfaces 4 and 5 to which they are attached. The frame 17 accordingly extends from the front in a downward and inward direction, and the frame 18 extends downwardly and inwardly from the rear of the seat arrangement. Thus, as illustrated in FIGS. 1–3, the vertical support struts 2 and 3 are connected to edges of the support flanges 17 and 18 and support the frames so that each frame 17 and 18 is a cantilever inwardly extending from its vertical support strut toward the other vertical support strut and is within the confines of the base 1. As shown in FIGS. 2 and 3, the support surfaces 5 and 4 can overlap around the innermost portion 18' or 17' of the frame 18 or 17 so that a person seated on these surfaces does not come into direct contact with those frame portions 17' and 18'. A retaining bar 19 may be welded onto the frame, such as the frame 18, so as to provide additional support for the support surface, such as the support surface 5.

The metal tubes 13 and 14 and the metal tubes 15 and 16 can be connected and stiffened by means of transversely extending connectors such as an upper transverse connector 20 and a lower transverse connector 21 as shown in FIG. 1. The tubes 13 and 14 and the tubes 15 and 16 of the respective load bearing assemblies 2 and 3 can be separated from the base portion 1 at respective butt joints 22 and 23 at which location they can be connected in a manner permitting dismantling of the assembly, such as by a sleeve arrangement as shown in FIG. 3 wherein a slightly recessed portion 22' of the base portion 1 extends into the interior of one of the tubes, such as tube 13. This not only facilitates the fabrication of the seat arrangement, but also reduces the space requirement necessary during shipping or when the seat is not being used.

Figure 9:
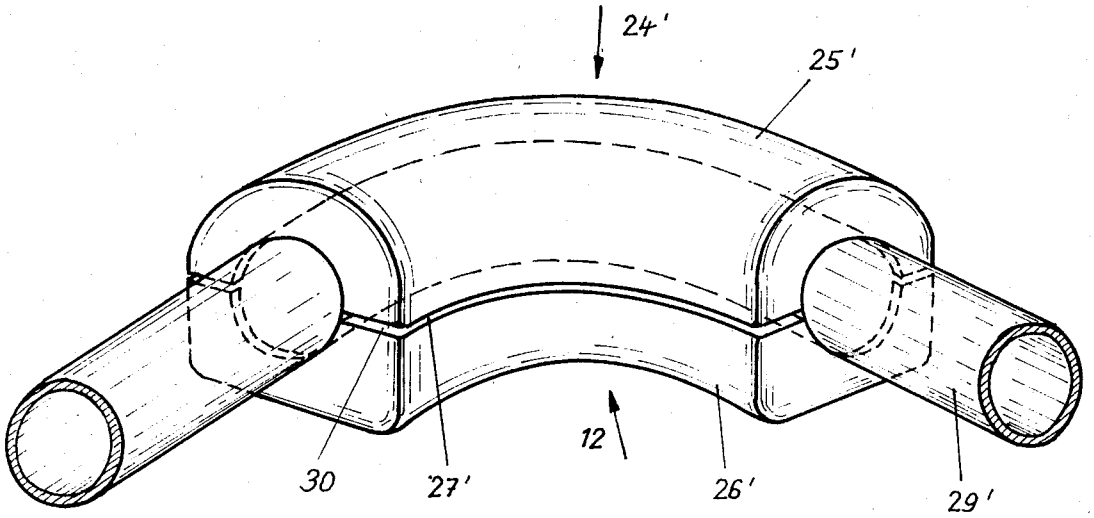
FIG. 9 is a perspective view of a portion of the base support showing a third embodiment.
Figure 11:
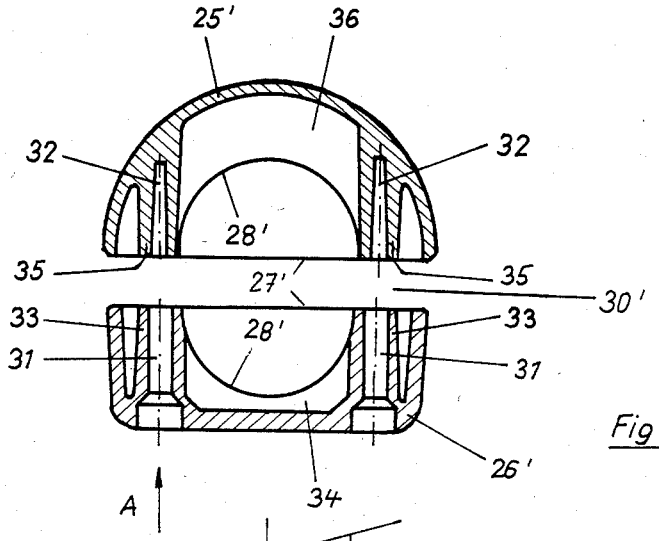
FIG. 11 is a sectional view taken along line XI—XI in FIG. 10 including the associated upper half of the base support.
Figure 10:
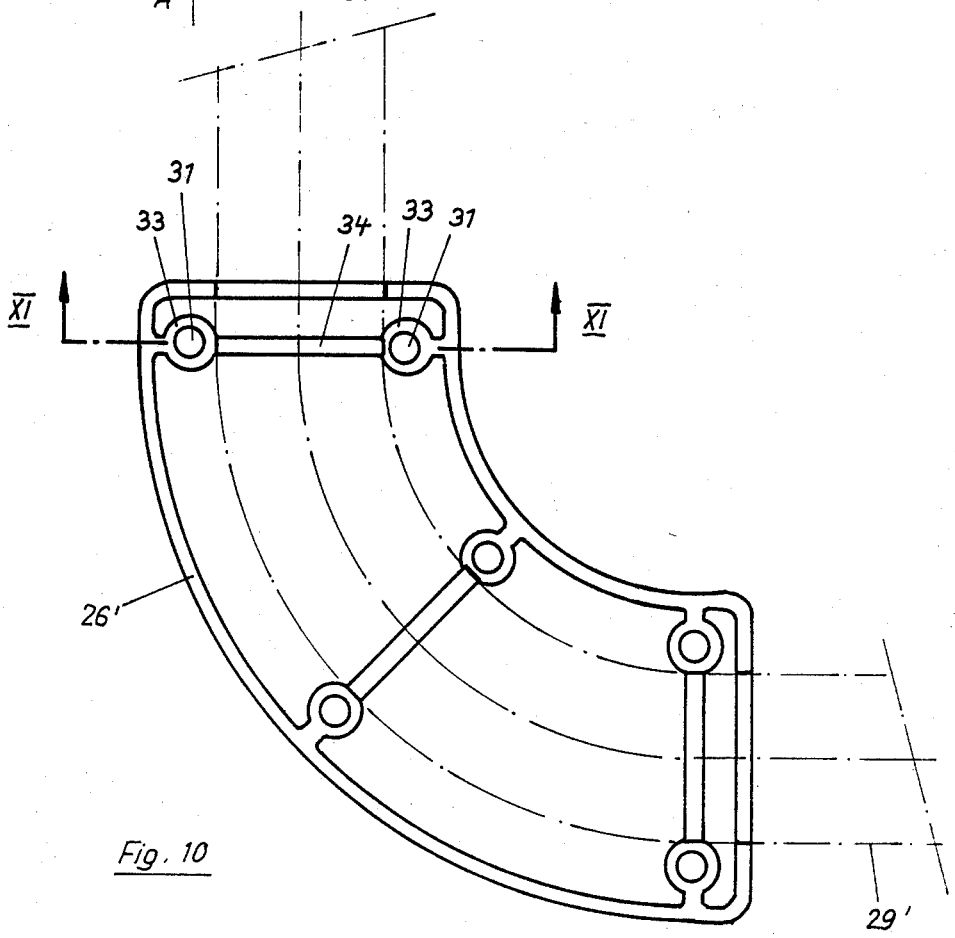
FIG. 10 is a plan view of the bottom of the base support shown in FIG. 9.

The base portion 1 has a number of base supports preferably disposed at the arced corners 12. An exemplary embodiment of a base support is shown in detail in FIGS. 4, 5 and 6, a simplified second embodiment is shown in FIGS. 7 and 8, and a third embodiment is shown in FIGS. 9, 10 and 11. In the embodiments shown in FIGS. 4 through 8, the base supports 24 consist of two halves 25 and 26 which have vertically abutting surfaces 27. Each half has an interior recess 28. In the embodiment shown in FIGS. 4 through 6, the recesses 28 are semicircular in shape, so that together the recesses form a complete circle which corresponds to the cross section of the metal tube, herein referenced at 29, for the base portion 1. The shape and size of the recesses 28 is preferably matched to the cross section of a commercially available metal tube so that when the halves 25 and 26 are placed on the metal tube from opposite sides they enclose the metal tube with the recesses 28 fitting closely to the tube surface. A small gap 30 still remains at which the abutting surfaces 27 are located.

The embodiments shown in FIGS. 4 through 8 also includes a fastener 37 for connecting the two halves 26 in a manner which permits removal of the base support from the base portion 1. The fastener 38 passes through a foot 38 of the base support 24 which has a lower supporting surface 39 which is preferably flat. In these embodiments, the fastener 37 is disposed parallel to the support surface 39 and at a right angle with respect to the longitudinal direction of the base support 24. In this embodiment the foot 38 is sufficiently high such that the screw 37 does not enter the area of the recesses 28. Both halves 25 and 26 may further possess interlocking projections and recesses on their abutting surfaces 27, particularly in the region of the foot 38, one of such projections being shown at 40. Such projections permit fitting of the halves 25 and 26 together in a relatively easy manner in the correct position, and prevents unintentional relative sliding of the halves 25 and 26 during this phase of the assembly between the fitting together of the halves and tightening of the fastener 37.

Figure 4:
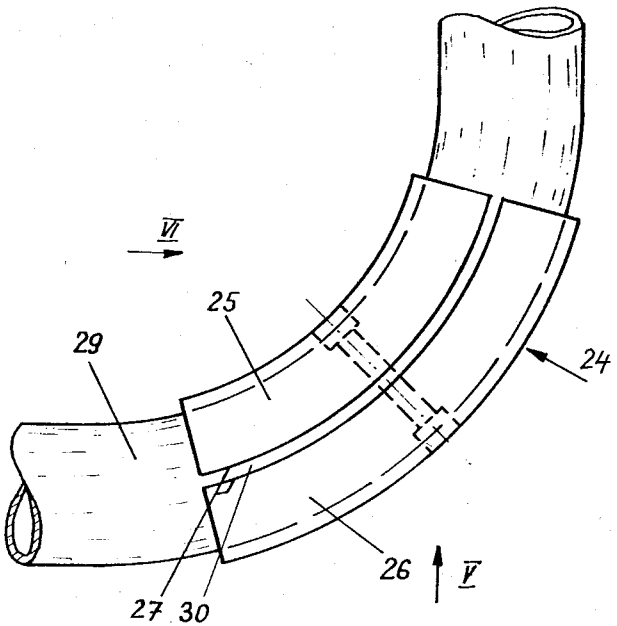
FIG. 4 is a plan view of a portion of a base support with the associated corner of the base portion.
Figure 5:
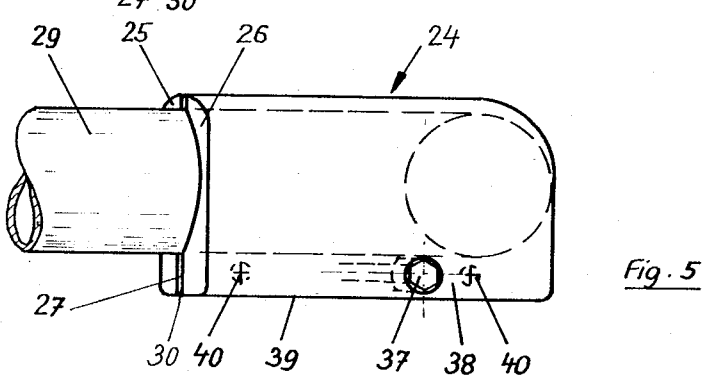
FIG. 5 is a side view taken in the direction of arrow V in FIG. 4.
Figure 6:
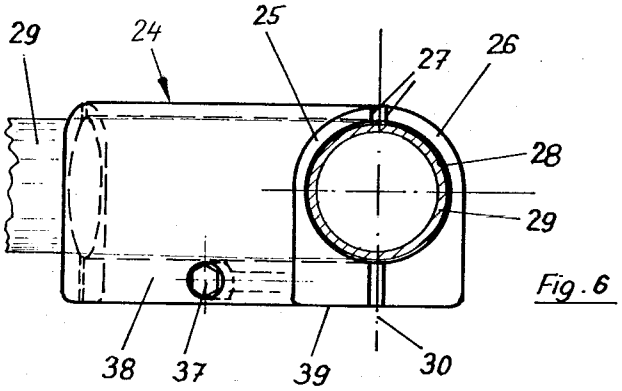
FIG. 6 is an end view taken in the direction of the arrow VI in FIG. 4.
Figure 7:
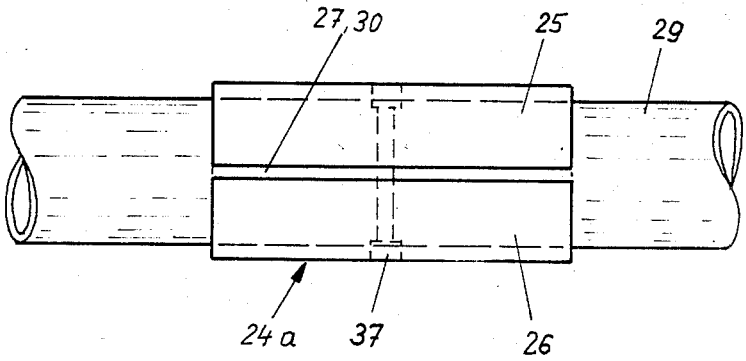
FIG. 7 is a side view of a portion of the base support showing a second embodiment.
Figure 8:
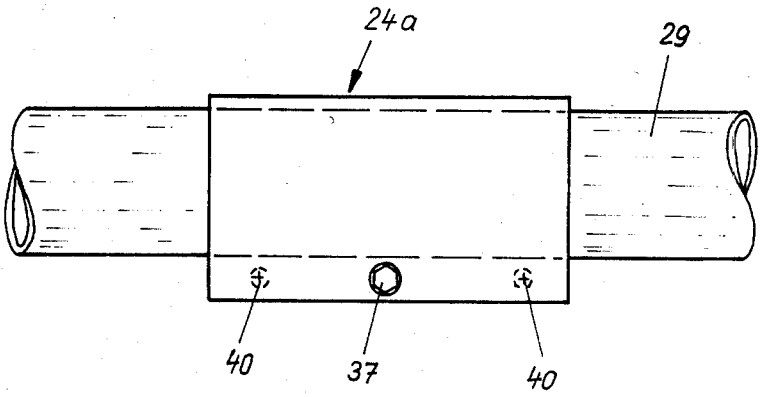
FIG. 8 is a plan view of the second embodiment shown in FIG. 7.

As can be seen by comparing the embodiment of the base support 24 shown in FIGS. 4 through 6 with the embodiment of the base support **24*a* shown in FIGS. 7 and 8, the base support 24 extends in its longitudinal direction in an arc fitted to the corresponding arc for the corner 12 of the base portion 1. This results in positioning of the base support 24 at a position most suitable for stability and secure standing. The cylinder formed by the two recesses 28 is similarly curved in accordance with the curvature of the tube 29**.

The simplified embodiment of the base support **24*a* shown in FIGS. 7 and 8 extends along a straight line and the portion of the base portion 1 which extends through the base support 24*a* accordingly also extends in a straight line. These base supports 24*a* may be disposed at any straight portion of the base portion 1**.

A further embodiment of a base support for the base portion 1 is shown in FIGS. 9 through 11 referenced at 24'. The base support 24' is comprised of two halves 25' and 26' which are separated from one another by abutting surfaces 27' which are disposed horizontally in the operating position. The halves 25' and 26' are curved as in the embodiment for the base support 24 such that the base support 24' can be fitted at the arced corners 12 of the base portion 1. The metal tube of the base portion 1 is in this embodiment referenced at 29'. This configuration of the base support has the advantage that the gap 30' is invisible from above and it is much more difficult for dirt to penetrate into the gap from above.

As shown in FIGS. 10 and 11, fasteners for securing the halves 25' and 26' to one another can be introduced from below and without coming into contact with the metal tube 29'. The screws and screw connections in this embodiment are invisible when the base support 24' is disposed in an operating position. A larger number of fasteners can be accommodated in this third embodiment than in the embodiments shown in FIGS. 4 through 8. As shown in FIGS. 10 and 11, six fastener receptacles 31 are present in the lower half 26 and associated receptacles 32 are disposed in registry therewith in the upper half 25'. The fastener is inserted in the direction of arrow A shown in FIG. 11. If a screw is used as a fastener, the dimensions of the base support 24' are selected such that the screw thread does not engage the walls 33 of the receptacles 31, but does engage the walls of the receptacles 32 in the upper half 25', which have a smaller diameter than do the receptacles 31, such that the threads of the screws bite into the walls 35 of the receptacles 32 and hold the halves 25' and 26' together. For this purpose the halves 25' and 26', and particularly the upper half 25', are comprised of a plastic.

As can also be seen in FIG. 10, the receptacles 31 and their associated walls 33 are disposed in transverse ribs 34 which can be injection molded integrally with the base support half 26' if the half 26' is made of plastic. The receptacles 32 and their associated walls 35 and the ribs 36 in the upper half 25' can also be injection molded in this manner. The ribs 34 and 36 stiffen the respective halves 26' and 25' and are also provided with recesses 28' which correspond in form and function to the recesses 28 of the embodiment shown in FIGS. 4 through 6 which has already been explained.

In comparison to conventional base supports which are made of plastic and screwed into the tube forming the frame of the furniture item, the base supports disclosed and claimed in combination with the seating arrangement herein have the advantage that no threaded holes need to be manufactured in the metal tube. This has the particular advantage of eliminating any entrance for water or moisture to the inside of the tube through such holes. The risk of rusting of the frame is thus substantially eliminated. The metal tubes may consist, for example, of chromium plated steel tubes or aluminum tubes.

Although modifications and changes may be suggested by those skilled in the art it is the intention of the inventor to embody within the patent warranted hereon all changes and modifications as reasonably and properly come within the scope of his contribution to the art.

I claim as my invention:

1. A seat arrangement comprising: a common frame including a horizontal base having a pair of spaced-apart ends with longitudinal side members extending therebetween, a first vertical support strut extending upwardly from a center of one end of the pair of spaced-apart ends and a second vertical support strut extending upwardly from the other end of said spaced-apart ends, said first vertical support strut being connected to an edge of a first support frame with the first support frame being a cantilever spaced above the base and extending inwardly from the first strut towards the second strut with a projection of the first support frame being within the confines of the base, said second vertical support strut being connected to an edge of a second support frame with the second support frame being a cantilever spaced above the base and extending inwardly from the second strut towards the first strut with a projection of the second support frame being within the confines of the base; a first unitary support surface for supporting the buttocks of a person seated on said seating arrangement, said first unitary support surface being mounted on said first support frame inward of the first vertical support strut; and a second unitary support surface for supporting the knees and shins of said person, said second unitary support surface being mounted on said second support frame inward of said second vertical support strut so that both the first unitary support surface and the second unitary support surface are within the confines of the base.

2. The seat arrangement according to claim 1, wherein each of said first and second support frames extend downward from its connection to the vertical support strut and at an angle to the base so that the first support surface extends at an angle to the base and the second support surface.

3. A seat arrangement comprising: a common frame including a horizontal base having a pair of spaced-apart ends with at least one longitudinal member extending therebetween, a first vertical support strut extending upwardly from a center of one end of the pair of spaced-apart ends and a second vertical support strut extending upwardly from the other end of said spaced-apart ends, said first vertical support strut being connected to an edge of a first support frame with the first support frame being a cantilever spaced above the base and extending inwardly from the first strut towards the second strut with a projection of the first support frame being within the confines of the base, said second vertical support strut being connected to an edge of a second support frame with the second support frame being a cantilever spaced above the base and extending inwardly from the second strut towards the first strut with a projection of the second support frame being within the confines of the base; a first unitary support surface for supporting the buttocks of a person seated on said seating arrangement, said first unitary support surface being mounted on said first support frame inward of the first vertical support strut; and a second unitary support surface for supporting the knees and shins of said person, said second unitary support surface being mounted on said second support frame inward of said second vertical support strut so that both the first unitary support surface and the second unitary support surface are within the confines of the base.

4. The seat arrangement of claim 1, wherein said base and struts are formed of two tubes allochirally arranged.

5. The seat arrangement according to claim 1, wherein each of the first and second vertical support struts is formed by a pair of parallel extending tubes.

6. The seat arrangement according to claim 1, wherein the common frame is formed of two metal tubes with one tube forming one outboard side member of the common frame and the other tube forming the other outboard side member, said tubes at each end having a portion curving toward the other tube to form the ends of the base and another portion extending upward from the base to form part of each of the vertical support struts.

7. The seat arrangement according to claim 6, wherein the two tubes are allochirally arranged and the base has a rectangular shape.

8. The seat arrangement according to claim 1, wherein the frame with the vertical struts is formed of metal tubes and the ends and side members of the base of the frame are joined by curved portions and the struts are joined to the ends of the base by curved portions.

* * * * *